United States Patent [19]

Latraverse et al.

[11] Patent Number: 5,033,211

[45] Date of Patent: Jul. 23, 1991

[54] CLEAT MEMBER AND SLOT SYSTEM

[75] Inventors: Paul A. Latraverse; Harris L. MacNeill, both of Northborough; Thomas W. Erich, Holliston, all of Mass.

[73] Assignee: MacNeill Engineering Company, Inc., Marlborough, Mass.

[21] Appl. No.: 400,355

[22] Filed: Aug. 30, 1989

[51] Int. Cl.[5] ..... A43B 5/00

[52] U.S. Cl. ..... 36/134; 36/67 D

[58] Field of Search ..... 36/134, 67 D, 67 R

[56] References Cited

U.S. PATENT DOCUMENTS

| | | | |
|---|---|---|---|
| 1,141,889 | 6/1915 | Trolle | 36/134 X |
| 1,768,426 | 6/1930 | Stelzer | 36/67 D |
| 2,213,289 | 9/1940 | Riddell | 36/67 D |
| 2,292,239 | 8/1942 | Pierce et al. | 36/67 D |
| 2,299,927 | 10/1942 | Pierce et al. | 36/67 D |
| 2,306,308 | 12/1942 | Goldenberg | 36/67 D |
| 2,309,783 | 2/1943 | Park | 36/67 D |
| 2,315,874 | 4/1943 | Sabel et al. | 36/134 X |
| 2,459,610 | 1/1949 | Zadina | 36/67 D |
| 2,682,714 | 7/1954 | Phillips | 36/67 D |
| 3,156,987 | 11/1964 | Dassler | 36/134 X |
| 3,204,347 | 9/1965 | Snow | 36/134 X |
| 3,492,744 | 2/1970 | Bernier | 36/134 X |
| 3,553,858 | 1/1971 | Austin | 36/134 X |
| 4,723,366 | 2/1988 | Hagger | 36/67 D |

FOREIGN PATENT DOCUMENTS

| | | | |
|---|---|---|---|
| 2542035 | 3/1977 | Fed. Rep. of Germany | 36/67 D |
| 2163037 | 2/1986 | United Kingdom | 36/134 |

*Primary Examiner*—Jimmy G. Foster
*Assistant Examiner*—Ted Kavanaugh
*Attorney, Agent, or Firm*—Bromberg & Sunstein

[57] ABSTRACT

A removable traction cleat is provided having an improved skirt design providing slots that may receive a wrench for removing the cleat. In one embodiment, the spike and screw of the cleat are made of metal, while the skirt is made of plastic. In another embodiment, a metal infrastructure is encased inside the plastic skirt in order to reinforce the skirt.

4 Claims, 3 Drawing Sheets

CLEAT MEMBER AND SLOT SYSTEM

TECHNICAL FIELD

This invention relates to traction cleats for shoes, in particular to removable golf cleats suitable fo golf and other sports and field use.

BACKGROUND OF THE INVENTION

The present invention is an improvement on removable traction cleats that use relatively wide skirts. An example of such a cleat is disclosed in U.S. Pat. No. 4,723,366, which is hereby incorporated herein by reference. Cleats typically comprise an axial member that at one end include an engagement device, such as a screw, for removably attaching the cleat to the shoe, and at the second end a narrow spike for engaging the ground. Removable cleats that are used on golf shoes typically have a skirt extending radially outward from the region between the two ends of the axial member. Typically the skirt has two holes disposed on either side of the spike for receiving a specially designed wrench, which can be used to twist off or on the cleat. These holes frequently become clogged with mud. If the mud is allowed to dry and harden, it becomes very difficult to remove the dried mud and use the wrench.

DISCLOSURE OF THE INVENTION

The present invention is a removable cleat having an improved skirt design providing slots that open to the sides of the skirt as well as the bottom face of the skirt. This invention is particularly well suited to cleats having wide skirts; that is, skirts having a radius longer than the length of the spike, or, at least, not significantly shorter than the length of the spike. This invention enables easier removal of mud that may have hardened in and around the cleat.

In one embodiment the slots extend all the way through the skirts. In another embodiment, the slots extend only partway through the skirt.

In a preferred embodiment, the spike and the screw of the cleat are made of metal, while the skirt is made of plastic. A metal infrastructure can be encased inside the plastic skirt in order to reinforce the skirt. This metal infrastructure would be attached to the spike and screw.

BRIEF DESCRIPTION OF THE DRAWINGS

These and other features of the invention would be more readily understood by consideration of the following detailed description, taken with the accompanying drawings, in which.

DESCRIPTION OF SPECIFIC EMBODIMENTS

Figure 1A:
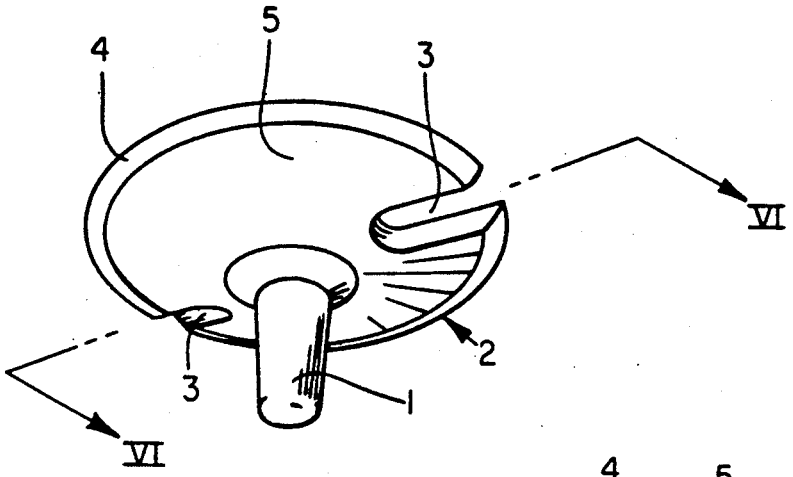
FIGS. 1A and 1B are perspective views from below of two alternative embodiments of a traction cleat in accordance with the invention.
Figure 1B:
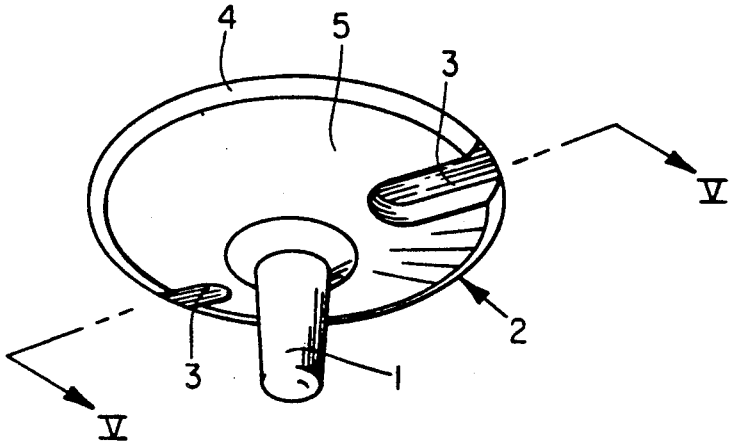
Figure 2:
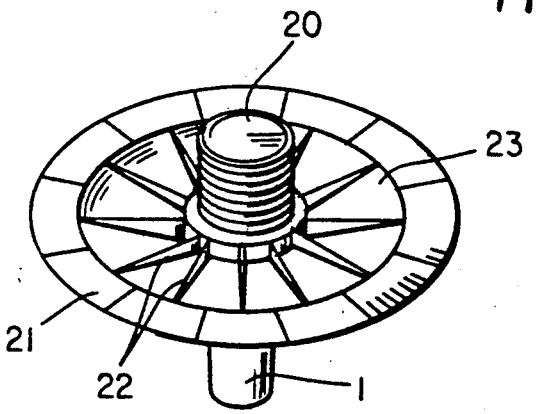
FIG. 2 is a perspective view from above of a preferred embodiment of the cleat shown in FIG. 1B.

FIGS. 1A and 1B show preferred embodiments of the invention. In these views the spike 1, which engages the ground, and the skirt 2 are visible. The spike extends downwardly and is part of the axial member, the other end of which is a screw. FIG. 2 shows the screw 20 on the other end of the axial member. The screw 20 is used for attaching the cleat to the sole of the shoe, which has a receptacle for receiving the screw. Of course, other means of attaching the cleat to the shoe may be used. The present invention, however, is directed towards cleats that need to be turned in order to be removed. The skirt 2 extends radially from the axial member at the region between the screw 20 and the spike 1. In a preferred embodiment, the axial member, including the spike 1 and the screw 20, is made of an integral piece of metal, and the skirt 2 is made of a plastic.

The skirt has two sides, a bottom side 5, which comes in contact with the ground and is shown in FIGS. 1A and 1B, and a top side 23, which faces against the outsole of the shoe and is shown in FIG. 2. The skirt 2 may also be considered to have a rim 4, which may not be distinct from the bottom side 5. Indeed, it is preferable to have the rim 4 and bottom side 5 form a smooth, continous surface. The rim 4 faces generally away from the axial member. The FIG. 1A embodiment has two slots 3 which are disposed radially and extend axially through the skirt 2, such that the slots are open to the bottom side 5, the top side (not shown in FIG. 1A) and the rim 4. FIG. 1B shows an alterative preferred embodiment where the slots 3 do not extend all the way through the skirt 2 such that the slots 3 are open only to the bottom side 5 and the rim 4. In both embodiments, the slots open downward and also away from axial member. These slots are designed to be fitted to a specially designed wrench. One uses the wrench to fit the slots to grip the cleat, so that the cleat can be twisted and screwed on or off. Prior art cleats used holes instead of slots 3. The advantage of using slots that open to the rim 4 (away from the axial member) is that, unlike holes, the slots can be easily cleared of hardened mud. By using a narrow implement that can fit into the slot 3, caked-on mud can be loosened and pushed towards the rim where it can easily fall out. Thus, by having the slots open downward and away from the axial member, the cleat of the present invention is much easier to clean of hardened mud than prior art cleats.

FIG. 2 shows a perspective view from above of the cleat shown in FIG. 1B. The slots cannot be seen from this view, since the slots in the FIG. IB cleat do not extend all the way through the skirt 2. In FIG. 2, outer ridges 21 and inner ridges 22 can be seen on the top side of the skirt. Each ridge is disposed radially with respect to the axial member. The inner ridges 22 are located more closely to the axial member, and the outer ridges 21 are located further away from the axial member. The ridges grip the sole of the shoe and resist the turning of the cleat, so that the cleat does not easily become loose. There are fewer inner ridges 22 than outer ridges 21, because otherwise the inner ridges would become too close to each other and would thereby become less effective at gripping the sole of the shoe.

Figure 3:
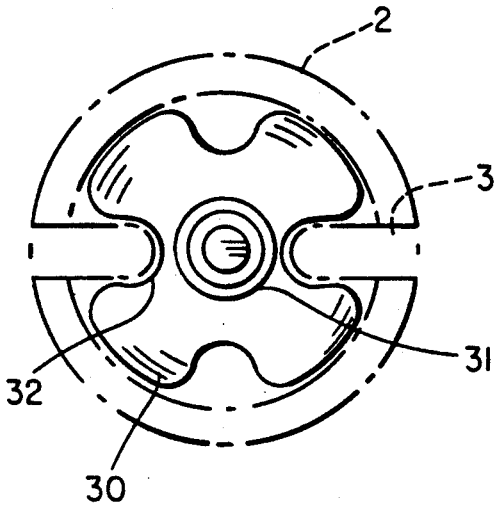
FIG. 3 is a bottom plan view of a preferred embodiment of the cleat shown in FIG. 1B showing the plastic skirt in phantom and the metal portion of the cleat in solid lines.
Figure 4:
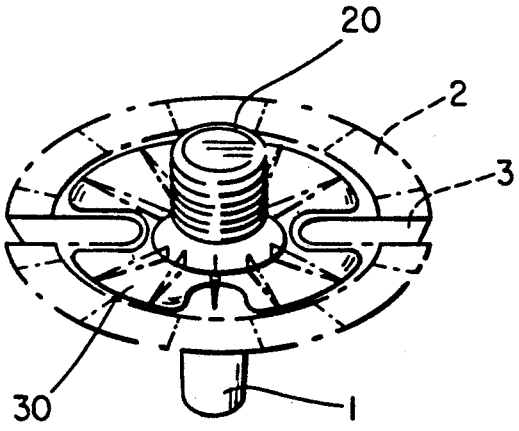
FIG. 4 shows a perspective view from above of a preferred embodiment of the cleat shown in FIG. 1A, wherein the plastic skirt is shown in phantom, and the metal portion of the cleat is shown with solid lines.

In order to increase the strength of the plastic skirt, metal flanges can extend from the axial member into the skirt. In a preferred embodiment, these metal flanges are be completed encased in the plastic skirt. FIG. 3 shows these metal flanges 30 extending from the axial member 31. The skirt 2 is shown in phantom. FIG. 4 shows this feature used in the cleat depicted in FIG. 1A. The metal flanges 30 extend from the axial member at the region between the screw 20 and the spike 1. The flanges are encased in the skirt 2, which is shown in phantom. The slots 3 run all the way through the skirt 2. The slots 3 are disposed between the flanges, so that the flanges provide reinforcing support at the points where the wrench applies torque to the cleat.

Figure 5:
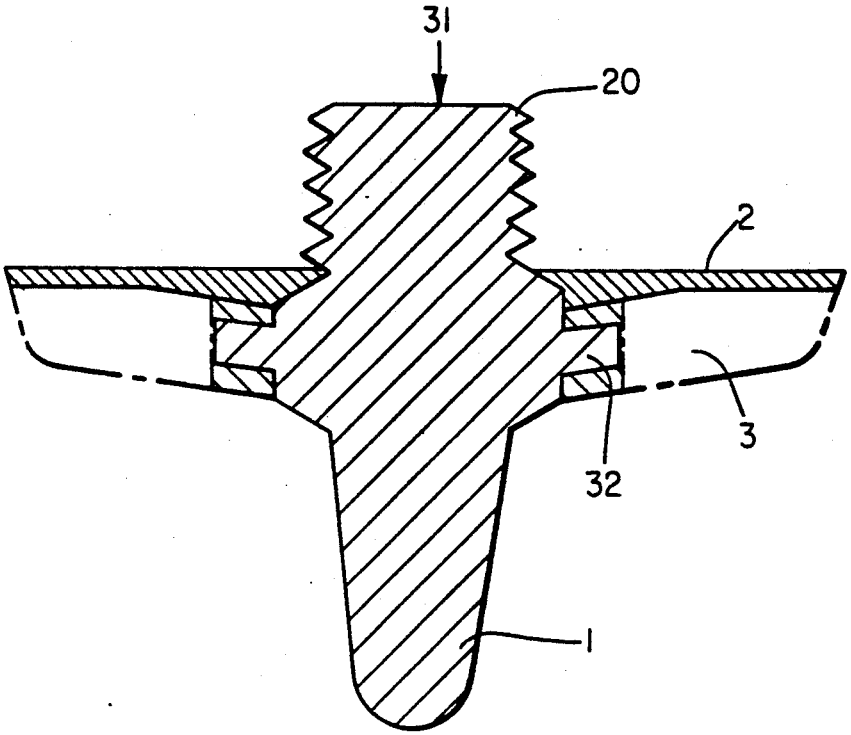
FIGS. 5 and 6 show cross sections taken respectively along line V—V in FIG. 1B and along line VI—VI in FIG. 1A.
Figure 6:
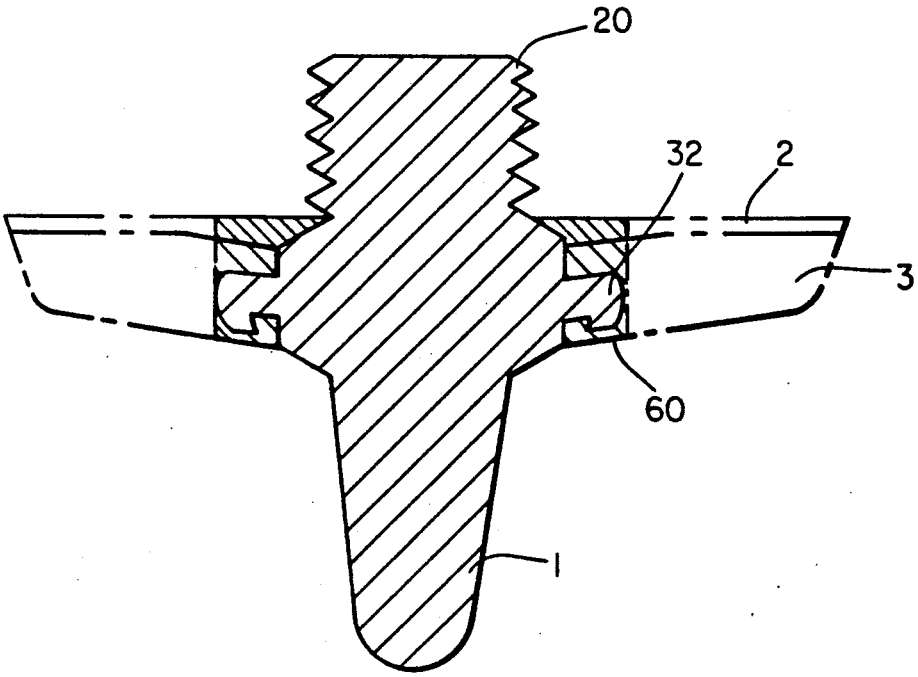

FIGS. 5 and 6 show cross sections of two embodiments of the invention. FIG. 5 shows a cleat wherein the slot 3 does not run all the way through the skirt 2. The base 32 of the flanges, shown in FIG. 3, is shown to be attached to the axial member 31. FIG. 6 shows a cleat where the slot runs all the way through the skirt 2. The perimeter of the metal flange is turned downward to form a lip 60. This lip provides greater reinforcement at those locations where the wrench applies torque to the cleat.

What is claimed is:

1. A traction cleat for removable attachment to the underside of footwear, the cleat comprising:

(a) an integral axial member, having a vertical axis and first and second ends, and including i. at the first end, attachment means for removably attaching the cleat with a mated receptacle in the underside of the footwear, and ii. at the second end, a ground-engaging head portion; and (b) a skirt rigidly attached to and extending radially outward from a region between the attachment means and the head portion along the vertical axis, the radius of the skirt not being significantly less than the length of the head portion, the skirt having i. a first side, facing in the direction of the first end, and ii. a second side, facing in the direction of the second end, and the skirt defining at least one slot that extends substantially from the axial member to the circumference of the skirt and that opens to the second side and away from the axial member, wherein the slot extends only partially through the skirt such that the slot does not open to the first side wherein metal flanges extend from the axial member into the plastic skirt and wherein the perimeter of the metal is turned downward to form a raised lip of substantial height and substantial width.

2. A cleat according to claim 1, wherein the skirt has a rim facing generally away from the axial member, and the slot opens to the rim.

3. A traction cleat according to claim 1, wherein the skirt is made of plastic material.

4. A traction cleat according to claim 3, wherein the flanges are encased inside the plastic skirt.

* * * * *